US007717963B2

(12) United States Patent
Yamaguchi et al.

(10) Patent No.: US 7,717,963 B2
(45) Date of Patent: May 18, 2010

(54) WATER- AND OIL-REPELLENT TREATMENT OF TEXTILE

(75) Inventors: Fumihiko Yamaguchi, Settsu (JP); Ikuo Yamamoto, Settsu (JP); Kayo Kusumi, Settsu (JP)

(73) Assignee: Daikin Industries Ltd., Osaka (JP)

( * ) Notice: Subject to any disclaimer, the term of this patent is extended or adjusted under 35 U.S.C. 154(b) by 77 days.

(21) Appl. No.: 11/546,301

(22) Filed: Oct. 12, 2006

(65) Prior Publication Data

US 2007/0028395 A1 Feb. 8, 2007

Related U.S. Application Data

(63) Continuation of application No. 10/127,501, filed on Apr. 23, 2002, now Pat. No. 7,147,669.

(30) Foreign Application Priority Data

Apr. 25, 2001 (JP) ..... 2001-127497

(51) Int. Cl.
*D06M 15/256* (2006.01)
*C09D 127/12* (2006.01)

(52) U.S. Cl. ..... 8/115.51; 8/115.56; 8/115.62; 8/115.64; 427/315; 427/377

(58) Field of Classification Search ..... 8/115.51, 8/115.54, 115.67, 115.69, 149.3, 115.41, 8/115.56, 115.62, 115.64; 252/8.62; 427/315, 427/377, 393.4, 394, 430.1; 524/457
See application file for complete search history.

(56) References Cited

U.S. PATENT DOCUMENTS 4,416,787 A 11/1983 Marshall et al.
5,073,442 A 12/1991 Knowlton et al.
5,516,337 A 5/1996 Nguyen
5,520,962 A 5/1996 Jones, Jr.
5,759,431 A * 6/1998 Nguyen ..... 252/8.62
5,851,595 A 12/1998 Jones, Jr.
6,197,378 B1 3/2001 Clark et al.
6,376,592 B1 4/2002 Shimada et al.
6,750,277 B1 * 6/2004 Yamana et al. ..... 524/261
2003/0115678 A1 * 6/2003 Enomoto et al. ..... 8/115.51

FOREIGN PATENT DOCUMENTS

WO WO 98/50619 11/1998
WO WO0181672 * 11/2001

* cited by examiner

*Primary Examiner*—Lorna M Douyon
*Assistant Examiner*—Tri V Nguyen
(74) *Attorney, Agent, or Firm*—Sughrue Mion, PLLC

(57) ABSTRACT

Excellent water repellency and Oil repellency are imparted to a textile by a method including (1) preparing a treatment liquid comprising a water- and oil-repellent agent,
(2) adjusting pH of the treatment liquid to at most 7,
(3) applying the treatment liquid to a textile,
(4) treating the textile with steam, and
(5) washing the textile with water and dehydrating the textile, wherein the water- and oil-repellent agent comprises at least one fluorine-containing compound selected from the group consisting of a fluorine-containing polymer and a fluorine-containing low molecular weight compound, and the water- and oil-repellent agent or the treatment liquid contains a cationic emulsifier and/or a salt.

15 Claims, No Drawings

WATER- AND OIL-REPELLENT TREATMENT OF TEXTILE

CROSS-REFERENCE TO RELATED APPLICATIONS

This application is a Continuation of application Ser. No. 10/127,501 filed Apr. 23, 2002, now U.S. Pat. No. 7,147,669, which claims benefit of Japanese Application No. 2001-127497 filed Apr. 25, 2001; the above-noted applications incorporated herein by reference in their entirety.

FIELD OF THE INVENTION

The present invention relates to a treatment for imparting excellent water repellency, oil repellency and soil releasability to a textile. The method of the present invention is particularly useful for treating a carpet.

BACKGROUND OF THE INVENTION

Hitherto, various treatment methods have been proposed in order to impart water repellency, oil repellency and soil releasability to a textile such as a carpet. For example, a process (hereinafter, sometimes referred to as "Exhaust process") of treating a textile comprising decreasing a pH of a treatment liquid, applying the treatment liquid to the textile, thermally treating the textile with steam, washing the textile with water, and dehydrating the textile is proposed.

A method comprising the Exhaust process is proposed in U.S. Pat. Nos. 5,073,442, 5,520,962, 5,516,337 and 5,851,595 and International Publication WO 98/50619.

U.S. Pat. No. 5,073,442 discloses a method of treating a textile, comprising conducting an Exhaust process by using a water- and oil-repellent agent comprising a fluorine-containing compound, a formaldehyde condensation product and an acrylic polymer. U.S. Pat. Nos. 5,520,962 and 5,851,595 disclose a method of treating a carpet, comprising conducting an Exhaust process by using a fluorine-containing compound and a polymeric binder. U.S. Pat. No. 5,516,337 discloses a method of treating a textile, comprising conducting an Exhaust process by using a fluorine-containing water- and oil-repellent agent and a metal compound such as aluminum sulfate. International Publication WO 98/50619 discloses a method of treating a carpet, comprising conducting an Exhaust process by using a fluorine-containing water- and oil-repellent agent and a salt such as a magnesium salt.

These methods mainly use the water- and oil-repellent agent in combination with the stain-blocking agent and can give water repellency and oil repellency when using the Exhaust process.

SUMMARY OF THE INVENTION

An object of the present invention is to give a textile excellent in water repellency and oil repellency, with only a water- and oil-repellent agent and without a stain blocking agent, when an Exhaust process is used.

The present invention provides a method of preparing a treated textile, comprising steps of:

(1) preparing a treatment liquid comprising a water- and oil-repellent agent, (2) adjusting pH of the treatment liquid to at most 7, (3) applying the treatment liquid to a textile, (4) treating the textile with steam, and (5) washing the textile with water and dehydrating the textile, wherein the water- and oil-repellent agent comprises at least one fluorine-containing compound selected from the group consisting of a fluorine-containing polymer and a fluorine-containing low molecular weight compound, and the water- and oil-repellent agent or the treatment liquid contains a cationic emulsifier and/or a salt.

The present invention also provides a textile prepared by the above-mentioned method, and a water- and oil-repellent agent used in the above-mentioned method.

The procedure used in the present invention is an Exhaust process which comprises decreasing pH of a treatment liquid comprising a fluorine-containing compound, applying a treatment liquid to a textile, thermally treating the textile, washing the textile with water, and dehydrating the textile.

DETAILED DESCRIPTION OF THE INVENTION

In the step (1) of the method of the present invention, the treatment liquid comprising the water- and oil-repellent agent, which is applied to the textile, is prepared. Even if the treatment liquid does not contain a stain blocking agent, the treatment liquid exhibits sufficient properties. Generally, the treatment liquid does not contain the stain blocking agent. The treatment liquid comprising the water- and oil-repellent agent may be in the form of a solution or an emulsion, particularly an aqueous emulsion. The treatment liquid contains at least one of the cationic emulsifier and/or the salt. The water- and oil-repellent agent may be prepared by emulsifying with an emulsifier such as the cationic emulsifier, or after the preparation of the water- and oil-repellent agent, both or one of the cationic emulsifier and the salt may be added to the water- and oil-repellent agent. The water- and oil-repellent agent before the preparation of the treatment liquid may contain the cationic emulsifier and/or the salt, or the cationic emulsifier and/or the salt may be added to the water- and oil-repellent agent to give the treatment liquid. In one embodiment of the present invention, the cationic emulsifier (or the salt) is preferably added, after the water- and oil-repellent agent is prepared (for example, after the emulsion of the water- and water-repellent agent is prepared).

The cationic emulsifier is generally a quaternary ammonium salt. Examples of the quaternary ammonium salt include an aliphatic quaternary ammonium salt, an aromatic quaternary ammonium salt and a heterocyclic quaternary ammonium salt. Examples of the cationic emulsifier include:

1) an alkyltrimethyl ammonium salt, 2) a dialkyldimethyl ammonium salt, and 3) a dipolyoxyethylenealkylmethyl ammonium salt.

The amount of the cationic emulsifier contained in the treatment liquid may be from 0 to 20 parts by weight, for example, from 0.5 to 15 parts by weight, particularly from 2 to 10 parts by weight, especially from 4 to 10 parts by weight, based on 100 parts by weight (solid content) of the fluorine-containing compound. The amount of the cationic emulsifier added to the water- and oil-repellent agent after the preparation of the water- and oil-repellent agent may be from 0.2 to 10 parts by weight, for example, from 0.5 to 8 parts by weight, particularly from 1 to 5 parts by weight, based on 100 parts by weight (solid content) of the fluorine-containing compound.

The salt is a compound wherein a hydrogen ion generated by ionization of an acid is replaced with a cation (for example, a metal ion and an ammonium ion).

The acid forming the salt is an organic acid or an inorganic acid.

Examples of the organic acid include an carboxylic acid having a —COOH group in molecule, a sulfonic acid having a $—SO_3H$ group or a sulfate monoester having a $—OSO_3H$ group.

Examples of the carboxylic acid include formic acid, acetic acid, oxalic acid, phthalic acid, citric acid, propionic acid and lactic acid. Examples of the sulfonic acid include taurine, a taurine derivative (N-cocoylmethyltaurine etc.) and an alkyl sulfonic acid (The carbon number of an alkyl group may be, for example, from 1 to 30, particularly from 5 to 20.) (for example, tetradecene sulfonic acid). Examples of the sulfate monoester include monoalkyl sulfate (The carbon number of an alkyl group may be, for example, from 1 to 30, particularly from 5 to 20.) and polyoxyalkylenealkylether sulfate (The carbon number of an oxyalkylene group may be 2 or 3, and the carbon number of an alkyl group may be, for example, from 1 to 30, particularly from 5 to 20.). Specific examples of the sulfate monoester include lauryl sulfate and polyoxyethylenelaurylether sulfate.

Examples of the inorganic acid include hydrochloric acid, sulfuric acid, sulfurous acid, nitric acid, phosphorous acid and phosphoric acid.

Examples of the cation in the salt include a metal ion and an ammonium ion.

A metal forming the metal ion is a mono- to tetra-valent metal, particularly a monovalent, divalent or trivalent metal. Examples of the metal include an alkaline metal (for example, potassium and sodium), an alkaline earth metal (for example, calcium and magnesium) and aluminum.

The salt may be a metal salt of inorganic acid (for example, a salt of polyvalent metal, particularly a salt of di- to tetravalent metal). Examples of the metal salt of inorganic acid include a sulfite salt, a sulfate salt, a hydrochloride salt, a phosphorous salt and a phosphate salt. Specific examples of the metal salt of inorganic acid include magnesium sulfate, aluminum sulfate, sodium sulfate, aluminum chloride, barium chloride, calcium chloride, magnesium chloride and sodium chloride.

Specific examples of the salt containing monovalent or divalent metal include LiCl, NaCl, NaBr, NaI, $CH_3COONa$, KCl, CsCl, $Li_2SO_4$, $Na_2SO_4$, $NH_4Cl$, $(NH_4)_2SO_4$, $(CH_3)_4NCl$, $MgCl_2$, $MgSO_4$, $CaCl_2$, $Ca(CH_3COO)_2$, $SrCl_2$, $BaCl_2$, $ZnCl_2$, $ZnSO_4$, $FeSO_4$, $CuSO_4$, HCOOLi, HCOOK, HCOONa, $(HCOO)_2Ca$, HCOOCs, $HCOONH_4$, $CH_3COOLi$, $CH_3COOK$, $(HCOO)_2Mg$, $(CH_3COO)_2Mg$, $(CH_3COO)_2Ca$, $(CH_3COO)_2Zn$, $(COOK)_2$ and $(COONa)_2$.

The amount of the salt may be from 0 to 500 parts by weight, for example, from 0.1 to 200 parts by weight, particularly from 0.5 to 50 parts by weight, based on 1 part by weight of the fluorine-containing compound.

In the step (2) in the method of the present invention, pH of the treatment liquid is brought to at most 7. The treatment liquid has pH of at most 7. pH of the treatment liquid is preferably at most 4, more preferably at most 3, for example, at most 2. pH can be decreased by addition of an acid such as an aqueous solution of citraconic acid and an aqueous solution of sulfamic acid to the treatment liquid.

In the step (3) of the method of the present invention, the treatment liquid is applied to the textile. The water- and oil-repellent agent can be applied to a substrate to be treated (that is, the textile) by a know procedure. The application of the treatment liquid can be conducted by immersion, spraying and coating. Usually, the treatment liquid is diluted with water, and is adhered to surfaces of the substrate by a well-known procedure such as an immersion coating, a spray coating and a foam coating to a fabric (for example, a carpet cloth), a yarn (for example, a carpet yarn) or an original fiber. If necessary, the treatment liquid is applied together with a suitable crosslinking agent, followed by curing. It is also possible to add mothproofing agents, softeners, antimicrobial agents, flame retardants, antistatic agents, paint fixing agents, crease-proofing agents, etc. to the treatment liquid. The concentration of the water- and oil-repellent agent active component (that is, the fluorine-containing compound) in the treatment liquid contacted with the substrate may be from 0.05 to 10 parts by weight, based on the treatment liquid.

In the step (4) of the method of the present invention, the textile is thermally treated. The thermal treatment can be conducted by applying a steam (for example, 80 to 120° C., particularly 90 to 110° C.) to the textile under a normal pressure for e.g., 5 seconds to 30 minutes, particularly 10 seconds to 10 minutes.

In the step (5) of the method of the present invention, the textile is washed with water and dehydrated. The thermally treated textile is washed with water at least once. Then, in order to remove excess water, the textile is dehydrated by a usual dehydration procedure such as a centrifuging and vacuuming procedure. After the step (5), the textile can be dried.

The fluorine-containing compound is a fluorine-containing polymer and/or a fluorine-containing low molecular weight compound.

The fluorine-containing polymer may be a polymer comprising a repeat unit derived from a fluoroalkyl group-containing monomer such as a fluoroalkyl group-containing (meth)acrylate, a fluoroalkyl group-containing maleate or fumarate, or a fluoroalkyl group-containing urethane.

The fluoroalkyl group-containing (meth)acrylate ester may be of the formula:

$$Rf\text{-}A\text{-}OCOCR^{11}{=}CH_2$$

wherein Rf is a fluoroalkyl group having 3 to 21 carbon atoms, $R^{11}$ is a hydrogen atom or a methyl group, and A is a divalent organic group.

In the above formula, A may be a linear or branched alkylene group having 1 to 20 carbon atoms, a $—SO_2N(R^{21})R^{22}—$ group or a $—CH_2CH(OR^{23})CH_2—$ group ($R^{21}$ is an alkyl group having 1 to 10 carbon atoms, $R^{22}$ is a linear or branched alkylene group having 1 to 10 carbon atoms, and $R^{23}$ is a hydrogen atom or an acyl group having 1 to 10 carbon atoms).

Examples of the fluoroalkyl group-containing (meth)acrylate are as follows:

$$Rf—SO_2—\overset{\overset{R^1}{|}}{N}R^2OCOCR^3{=}CH_2 \quad (1)$$

$$Rf—(CH_2)_nOCOCR^3{=}CH_2 \quad (2)$$

$$Rf—\overset{\overset{R^1}{|}}{C}ONR^2OCOCR^3{=}CH_2 \quad (3)$$

$$Rf—CH_2\overset{\overset{OH}{|}}{C}HCH_2OCOCR^3{=}CH_2 \quad (4)$$

$$Rf—CH_2\overset{\overset{OCOR^3}{|}}{C}HCH_2OCOCR^3{=}CH_2 \quad (5)$$

$$Rf—O—Ar—CH_2OCOCR^3{=}CH_2 \quad (6)$$

wherein Rf is a fluoroalkyl group having 3 to 21 carbon atoms, $R^1$ is a hydrogen atom or an alkyl group having 1 to 10 carbon atoms, $R^2$ is an alkylene group having 1 to 10 carbon atoms, $R^3$ is a hydrogen atom or a methyl group, and Ar is arylene group optionally having a substituent, and n is an integer of 1 to 10.

Specific examples of the fluoroalkyl group-containing (meth)acrylate are as follows:

$CF_3(CF_2)_7(CH_2)_{10}OCOCH{=}CH_2$ $CF_3(CF_2)_7(CH_2)_{10}OCOC(CH_3){=}CH_2$ $CF_3(CF_2)_6CH_2OCOCH{=}CH_2$ $CF_3(CF_2)_8CH_2OCOC(CH_3){=}CH_2$ $(CF_3)_2CF(CF_2)_6(CH_2)_2OCOCH{=}CH_2$ $(CF_3)_2CF(CF_2)_8(CH_2)_2OCOCH{=}CH_2$ $(CF_3)_2CF(CF_2)_{10}(CH_2)_2OCOCH{=}CH_2$ $(CF_3)_2CF(CF_2)_6(CH_2)_2OCOC(CH_3){=}CH_2$ $(CF_3)_2CF(CF_2)_8(CH_2)_2OCOC(CH_3){=}CH_2$ $(CF_3)_2CF(CF_2)_{10}(CH_2)_2OCOC(CH_3){=}CH_2$ $CF_3CF_2(CF_2)_6(CH_2)_2OCOCH{=}CH_2$ $CF_3CF_2(CF_2)_8(CH_2)_2OCOCH{=}CH_2$ $CF_3CF_2(CF_2)_{10}(CH_2)_2OCOCH{=}CH_2$ $CF_3CF_2(CF_2)_6(CH_2)_2OCOC(CH_3){=}CH_2$ $CF_3CF_2(CF_2)_8(CH_2)_2OCOC(CH_3){=}CH_2$ $CF_3CF_2(CF_2)_{10}(CH_2)_2OCOC(CH_3){=}CH_2$ $CF_3(CF_2)_7SO_2N(CH_3)(CH_2)_2OCOCH{=}CH_2$ $CF_3(CF_2)_7SO_2N(C_2H_5)(CH_2)_2OCOCH{=}CH_2$ $(CF_3)_2CF(CF_2)_8CH_2CH(OCOCH_3)CH_2OCOC(CH_3){=}CH_2$ $(CF_3)_2CF(CF_2)_6CH_2CH(OH)CH_2OCOCH{=}CH_2$

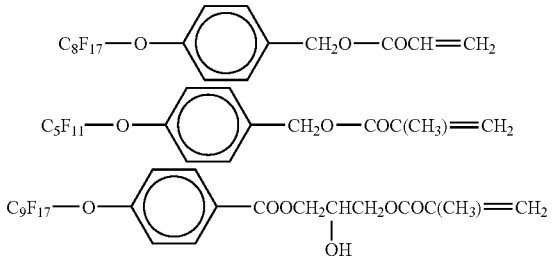

Examples of the fluoroalkyl group-containing maleate or fumarate deriving the fluorine-containing polymer include:

(A) an OH-containing, fluorine-containing maleate of the formula (I):

(I)

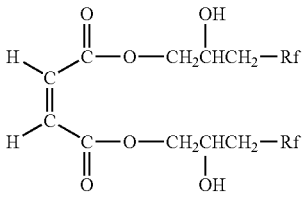

wherein Rf is a perfluoroalkyl group having 3 to 21 carbon atoms, an OH-containing, fluorine-containing fumarate of the formula (II):

(II)

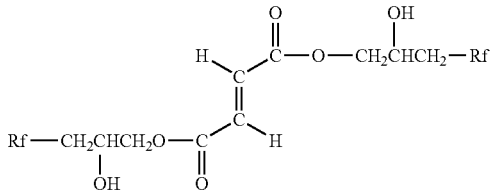

wherein Rf is a perfluoroalkyl group having 3 to 21 carbon atoms, a fluorine-containing maleate of the formula (III):

(III)

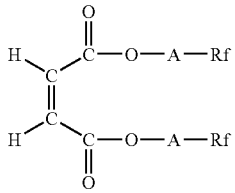

wherein Rf is a perfluoroalkyl group having 3 to 21 carbon atoms,

A is an alkylene group having 1 to 4 carbon atoms, or

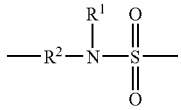

($R^1$ is a hydrogen atom or an alkyl group having 1 to 4 carbon atoms, and $R^2$ is an alkylene group having 1 to 4 carbon atoms.), and a fluorine-containing fumarate of the formula (IV):

(IV)

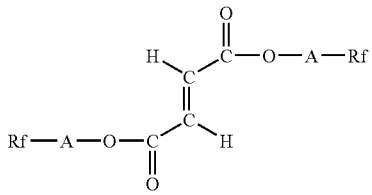

wherein Rf is a perfluoroalkyl group having 3 to 21 carbon atoms,

A is an alkylene group having 1 to 4 carbon atoms, or

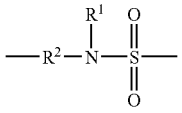

($R^1$ is a hydrogen atom or an alkyl group having 1 to 4 carbon atoms, and $R^2$ is an alkylene group having 1 to 4 carbon atoms.).

A fluoroalkyl group-containing urethane monomer deriving the fluorine-containing polymer can be prepared by reacting:

(a) a compound having at least two isocyanate groups, (b) a compound having one carbon-carbon double bond and at least one hydroxyl group or amino group, and (c) a fluorine-containing compound one hydroxyl group or amino group.

Examples of the compound (a) include the followings:

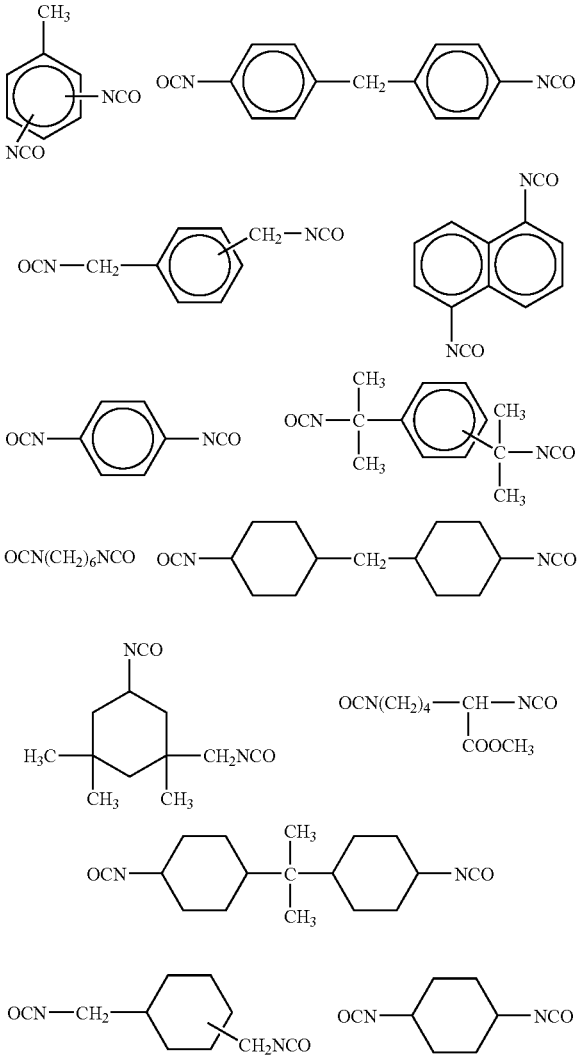

-continued

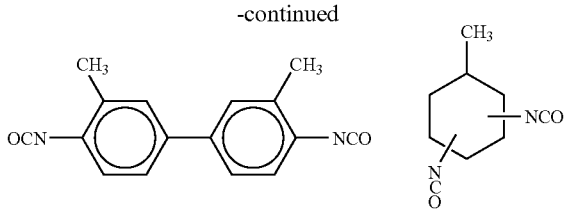

The compound (a) is preferably a diisocyanate. However, a triisocyanate and a polyisocyanate can be used for the reaction.

For example, a trimer of diisocyanate, polymeric MDI (diphenylmethane diisocyanate) and an adduct of diisocyanate with a polyhydric alcohol such as trimethylol propane, trimethylol ethane and glycerol can be also used for the reaction.

Examples of the triisocyanate and the polyisocyanate are as follows:

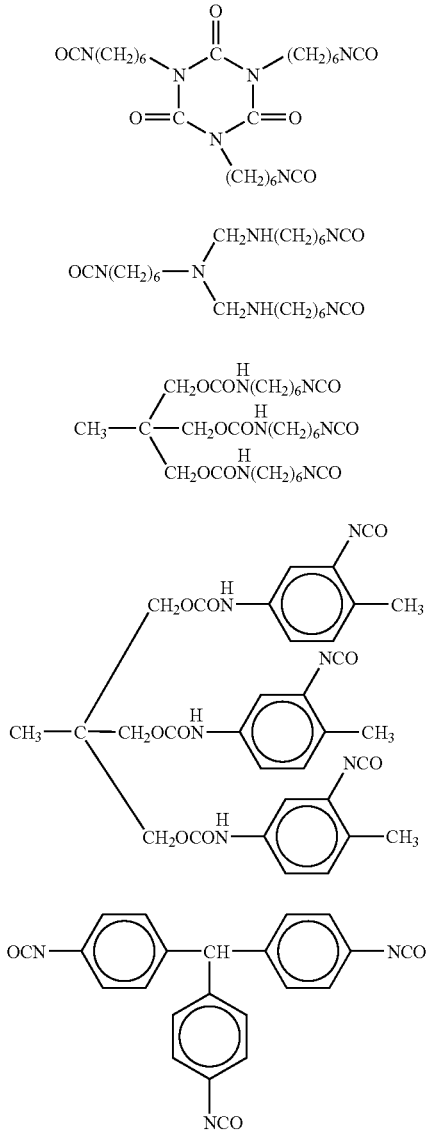

-continued

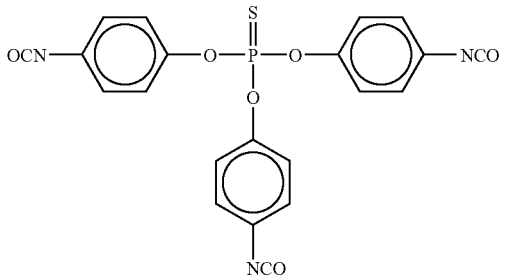

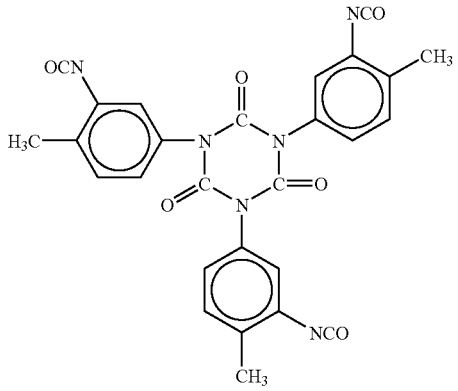

The compound (b) may be, for example, a compound of each of the formulas:

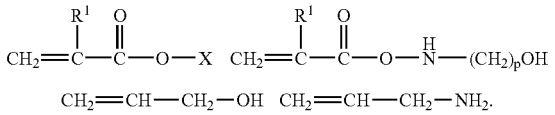

In the formula, $R^1$ is a hydrogen atom or a methyl group. X is as follows:

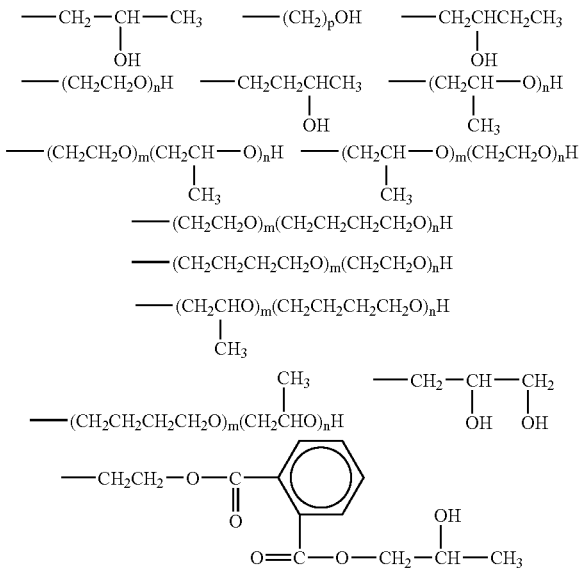

-continued

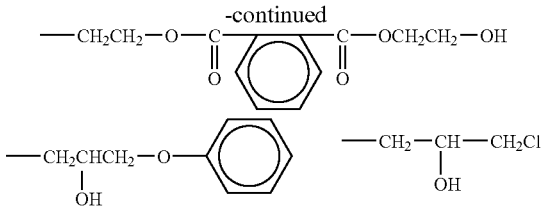

wherein m and n is a number of 1 to 300.

The compound (c) may be a compound of the formula:

$R_f—R^2—OH$, or $R_f—R^2—NH_2$ wherein $R_f$ is a fluoroalkyl group having 1 to 22 carbon atoms, and $R^2$ is an alkylene group having 1 to 10 carbon atoms and may have a heteroatom.

Examples of the compound (c) may be the following:

$CF_3CH_2OH$ $F(CF_2)_8CH_2CH_2OH$ $F(CF_2)_6(CH_2)_6OH$ $F(CF_2)_8SO_2N(CH_3)CH_2CH_2OH$ $F(CF_2)_3CH_2NH_2$ $F(CF_2)_7CH_2NH_2$

The compounds (a), (b) and (c) may be reacted such that when the compound (a) is a diisocyanate, both the compounds (b) and (c) are in amounts of 1 mol based on 1 mol of the compound (a); when the compound (a) is a triisocyanate, the compound (b) is in an amount of 1 mol and the compound (c) is in an amount of 2 mol based on 1 mol of the compound (a).

The fluorine-containing polymer constituting the water- and oil-repellent agent may comprise:

(I) a repeat unit derived from a monomer having a fluoroalkyl group, and (II) a repeat unit derived from a fluorine-free monomer.

The fluorine-containing polymer constituting the water- and oil-repellent agent may comprise:

(I) a repeat unit derived from a monomer having a fluoroalkyl group, (II) a repeat unit derived from a -fluorine-free monomer, and (III) a repeat unit derived from a crosslinkable monomer.

Examples of the monomer having fluoroalkyl group constituting the repeat unit (I) include the same as the above-mentioned fluoroalkyl group-containing monomer such as a fluoroalkyl group-containing (meth)acrylate.

The repeat unit (II) is preferably derived from a fluorine-free olefinically unsaturated monomer. Non-limiting examples of a preferable monomer constituting the repeat unit (II) include, for example, ethylene, vinyl acetate, vinyl chloride such as vinyl chloride, vinylidene halide such as vinylidene chloride, acrylonitrile, styrene, polyethyleneglycol (meth)acrylate, polypropyleneglycol (meth)acrylate, methoxypolyethyleneglycol (meth)acrylate, methoxypolypropyleneglycol (meth)acrylate, vinyl alkyl ether and isoprene.

The fluorine-containing polymer preferably contains vinyl halide or vinylidene halide.

The monomer constituting the repeat unit (II) may be a (meth)acrylate ester having an alkyl group. The number of carbon atoms of the alkyl group may be from 1 to 30, for example, from 6 to 30, e.g., from 10 to 30. For example, the monomer constituting the repeat unit (II) may be acrylates of the general formula:

$$CH_2{=}CA^3COOA^4$$

wherein $A^3$ is a hydrogen atom or a methyl group, and $A^4$ is an alkyl group represented by $C_nH_{2n+1}$ (n=1 to 30). The copolymerization with this monomer can optionally improve various properties such as water- and oil-repellency and soil releasability; cleaning durability, washing durability and abrasion resistance of said repellency and releasability; solubility in solvent; hardness; and feeling.

The crosslinkable monomer constituting the repeat unit (III) may be a fluorine-free vinyl monomer having at least two reactive groups. The crosslinkable monomer may be a compound having at least two carbon-carbon double bonds, or a compound having at least one carbon-carbon double bond and at least one reactive group.

Examples of the crosslinkable monomer include diacetoneacrylamide, (meth)acrylamide, N-methylolacrylamide, hydroxymethyl (meth)acrylate, hydroxyethyl (meth)acrylate, 3-chloro-2-hydroxypropyl (meth)acrylate, N,N-dimethylaminoethyl (meth)acrylate, N,N-diethylaminoethyl (meth)acrylate, butadiene, chloroprene and glycidyl (meth) acrylate, to which the crosslinkable monomer is not limited. The copolymerization with this monomer can optionally improve various properties such as water-repellency and soil releasability; cleaning durability and washing durability of said repellency and releasability; solubility in solvent; hardness; and feeling.

The fluorine-containing polymer preferably has a weight average molecular weight of 2,000 to 1,000,000, for example, 10,000 to 200,000.

Preferably, the amount of the repeat unit (I) is from 40 to 90% by weight, more preferably from 50 to 80% by weight, the amount of the repeat unit (II) is from 5 to 60% by weight, more preferably from 10 to 40% by weight, and the amount of the repeat unit (III) is from 0 to 10% by weight, more preferably 0.1 to 10% by weight, for example 0.5 to 10% by weight, based on the fluorine-containing polymer.

The fluorine-containing polymer in the present invention can be produced by any polymerization method, and the conditions of the polymerization reaction can be arbitrary selected. The polymerization method includes, for example, solution polymerization and emulsion polymerization. Among them, the emulsion polymerization is particularly preferred.

In the solution polymerization, there can be used a method of dissolving a monomer in an organic solvent in the presence of a polymerization initiator, and stirring the mixture with heating at the temperature within the range from 50 to 120° C. for 1 to 10 hours. Examples of the polymerization initiator include azobisisobutyronitrile, benzoyl peroxide, di-tert-butyl peroxide, lauryl peroxide, cumene hydroperoxide, t-butyl peroxypivalate and diisopropyl peroxydicarbonate. The polymerization initiator is used in the amount within the range from 0.01 to 5 parts by weight based on 100 parts by weight of the monomer.

The organic solvent is inert to the monomer and dissolves them, and examples thereof include pentane, hexane, heptane, octane, cyclohexane, benzene, toluene, xylene, petroleum ether, tetrahydrofuran, 1,4-dioxane, methyl ethyl ketone, methyl isobutyl ketone, ethyl acetate, butyl acetate, 1,1,2,2-tetrachloroethane, 1,1,1-trichloroethane, trichloroethylene, perchloroethylene, tetrachlorodifluoroethane and trichlorotrifluoroethane. The organic solvent may be used in the amount within the range from 50 to 1,000 parts by weight based on 100 parts by weight of the monomer.

In the emulsion polymerization, there can be used a method of emulsifying a monomer in water in the presence of a polymerization initiator and an emulsifying agent, replacing by nitrogen, and copolymerizing with stirring at the temperature within the range, for example, from 50 to 80° C. for 1 to 10 hours. As the polymerization initiator, for example, water-soluble initiators (e.g., benzoyl peroxide, lauroyl peroxide, t-butyl perbenzoate, 1-hydroxycyclohexyl hydroperoxide, 3-carboxypropionyl peroxide, acetyl peroxide, azobisisobutylamidine dihydrochloride, azobisisobutyronitrile, sodium peroxide, potassium persulfate and ammonium persulfate) and oil-soluble initiators (e.g., azobisisobutyronitrile, benzoyl peroxide, di-tert-butyl peroxide, lauryl peroxide, cumene hydroperoxide, t-butyl peroxypivalate and diisopropyl peroxydicarbonate) are used. The polymerization initiator is used in the amount within the range from 0.01 to 5 parts by weight based on 100 parts by weight of the monomer.

In order to obtain a copolymer dispersion in water, which is superior in storage stability, it is desirable that the monomers are atomized in water by using an emulsifying device capable of applying a strong shattering energy (e.g., a high-pressure homogenizer and an ultrasonic homogenizer) and then polymerized with using the water-soluble polymerization initiator. As the emulsifying agent, various emulsifying agents such as an anionic emulsifying agent, a cationic emulsifying agent and a nonionic emulsifying agent can be used in the amount within the range from 0.5 to 10 parts by weight based on 100 parts by weight of the monomers. The cationic emulsifying agent is particularly preferable. When the monomers are not completely compatibilized, a compatibilizing agent capable of sufficiently compatibilizing them (e.g., a water-soluble organic solvent and a low-molecular weight monomer) is preferably added to these monomers. By the addition of the compatibilizing agent, the emulsifiability and copolymerizability can be improved.

Examples of the water-soluble organic solvent include acetone, methyl ethyl ketone, ethyl acetate, propylene glycol, dipropylene glycol monomethyl ether, dipropylene glycol, tripropylene glycol and ethanol. The water-soluble organic solvent may be used in the amount within the range from 1 to 50 parts by weight, e.g., from 10 to 40 parts by weight, based on 100 parts by weight of water.

The fluorine-containing low molecular weight compound may have a molecular weight of less than 2,000, for example, from 500 to 1,500 and may be a fluoroalkyl group-containing compound.

The fluorine-containing low molecular weight compound may be, for example, a fluoroalkyl group-containing urethane or a fluoroalkyl group-containing ester.

The fluoroalkyl group-containing urethane can be prepared by reacting (i) a compound having at least two isocyanate groups, with (ii) a fluorine-containing compound having one hydroxyl group, amino group or epoxy group.

Examples of the compound having at least two isocyanate groups (i) are the same as those of the above-mentioned compound having at least two isocyanate groups (a) used for the fluoroalkyl group-containing urethane monomer deriving the fluorine-containing copolymer.

Specific examples of the fluorine-containing compound having one hydroxyl group, amino group or epoxy group (ii) are as follows:

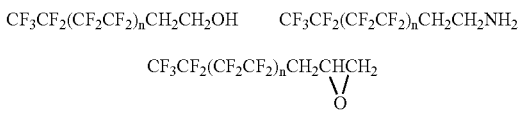

[n is from 2 to 8]

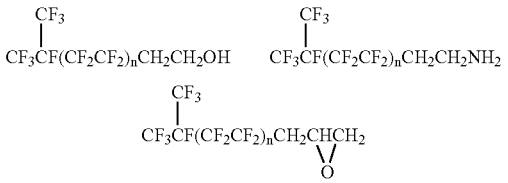

[n is from 2 to 8]

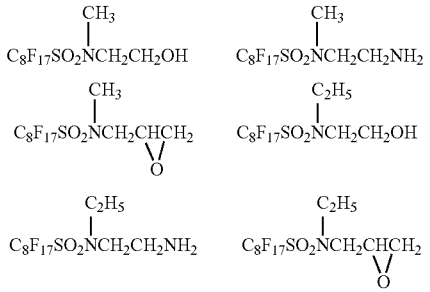

The fluoroalkyl group-containing ester can be prepared by reacting:

(iii) a polybasic carboxylic acid compound, with (ii) a fluorine-containing compound having one hydroxyl group, amino group or epoxy group.

The polybasic carboxylic acid compound is a compound having at least 2, preferably 2 to 4 carboxylic acid groups.

Specific examples of the polybasic carboxylic acid compound are as follows:

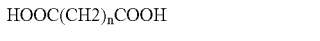

[n is 2, 4 or 6]

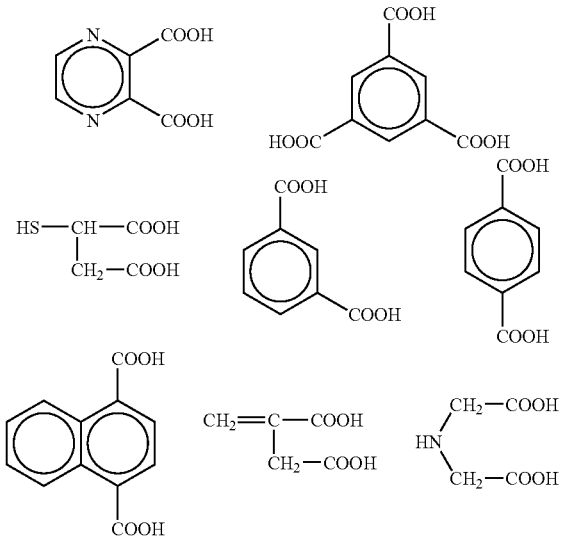

-continued

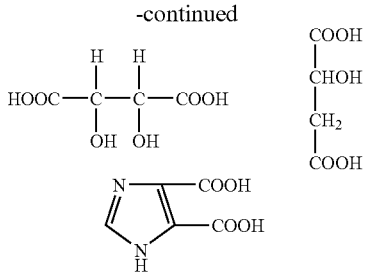

Examples of the fluorine-containing compound having one hydroxyl group, amino group or epoxy group (ii) forming the fluoroalkyl group-containing ester are the same as those of the above-mentioned fluorine-containing compound having one hydroxyl group, amino group or epoxy group (ii) forming the fluoroalkyl group-containing urethane.

The fluorine-containing compound may be the fluorine-containing polymer, the fluorine-containing low molecular weight compound, or a mixture of the fluorine-containing polymer and the fluorine-containing low molecular weight compound.

The amount of the fluorine-containing compound is at most 60% by weight, preferably from 1 to 40% by weight, for example, 1 to 30% by weight, based on the water- and oil-repellent agent. The amount of the emulsifier may be from 0.5 to 15 parts by weight, based on 100 parts by weight of the fluorine-containing compound.

The substrate to be treated in the present invention is preferably a textile, particularly a carpet. The textile includes various examples. Examples of the textile include animal- or vegetable-origin natural fibers such as cotton, hemp, wool and silk; synthetic fibers such as polyamide, polyester, polyvinyl alcohol, polyacrylonitrile, polyvinyl chloride and polypropylene; semisynthetic fibers such as rayon and acetate; inorganic fibers such as glass fiber, carbon fiber and asbestos fiber; and a mixture of these fibers. The present invention can be suitably used in carpets made of nylon fibers, polypropylene fibers and/or polyester fibers, because the present invention provides excellent resistance to a detergent solution and brushing (mechanical).

The textile may be in any form such as a fiber and a fabric. When the carpet is treated according to the method of the present invention, the carpet may be formed after the fibers or yarns are treated according to the present invention, or the formed carpet may be treated according to the present invention. The water- and oil-repellent agent can be used in the state that the fluorine-containing compound is diluted with a liquid medium such as water to the content of 0.02 to 30% by weight, preferably 0.02 to 10% by weight.

EXAMPLES

The following Examples further illustrate the present invention in detail but are not to be construed to limit the scope thereof. In the Examples, "%" is "% by weight" unless specified otherwise. The fluorine adhesion rate, water repellency, oil repellency and soil releasability of the carpets obtained in the Examples and Comparative Example were evaluated.

Test procedures of the fluorine adhesion rate, the water repellency, the oil repellency and the soil releasability are as follows.

Fluorine Adhesion Rate

A combustion flask is sufficiently washed with pure water. Then, 15 mL of pure water is charged into the combustion flask, and the weight of the flask containing water is measured. The weight of pure waster is determined by deducting a previously measured weight of the combustion flask from the weight of flask containing water. A platinum basket is heated twice or thrice to fully evaporate water. 75 mg of a carpet pile is weighed on a KIMWIPE, which is folded with enclosing a combustion aid (30 mg) and is positioned in a platinum basket. Oxygen is blown into the combustion flask, and the piles are burned and decomposed, and absorbed into pure water contained in the flask. After the absorption for 30 minutes, 10 mL of an absorption liquid and 10 mL of a buffer liquid (50 mL of acetic acid, 50 g of sodium chloride, 0.5 g of trisodium citrate dihydrate, and 32 g of sodium hydroxide are added to water to give a total amount of 1 L) are charged into a plastic cup and an F ion is measured by an F ion meter with sufficiently stirring. A fluorine adhesion amount and a fluorine adhesion rate are calculated according to the following equation.

Fluorine adhesion amount [ppm]=(Measurement value [ppm]−Blank measurement value [ppm])×(Pure water weight [g]/Pile weight [mg])×1000

Fluorine adhesion rate (%)=(Fluorine adhesion amount after steam treatment, water wash, centrifugal dehydration and thermal curing treatment [ppm])/(Fluorine adhesion amount immediately after squeezed so that WPU (wet pick up) is 400% or 300% [ppm])

The fluorine adhesion rate is shown as "Exhaust-ability" in the following Tables.

Water Repellency Test

A carpet treated with a water- and oil-repellent is stored in a thermo-hygrostat having a temperature of 21° C. and a humidity of 65% for at least 4 hours. A test liquid (isopropyl alcohol (IPA), water, and a mixture thereof, as shown in Table 1) which has been also stored at 21° C. is used. The test is conducted in an air-conditioned room having a temperature of 21° C. and a humidity of 65%. Droplets of the test liquid in an amount of 50 μL (5 droplets) are softly dropped by a micropipette on the carpet. If 4 or 5 droplets remain on the carpet after standing for 10 seconds, the test liquid passes the test. The water repellency is expressed by a point corresponding to a maximum content of isopropyl alcohol (% by volume) in the test liquid which passes the test. The water repellency is evaluated as sixteen levels which are Fail, 0, 0.2, 0.5, 1, 1.5, 2, 2.5, 3, 4, 5, 6, 7, 8, 9 and 10 in order of a bad level to an excellent level.

TABLE 1

| Water repellency test liquid (% by volume) | | |
|---|---|---|
| Point | Isopropyl alcohol | Water |
| 10 | 100 | 0 |
| 9 | 90 | 10 |
| 8 | 80 | 20 |
| 7 | 70 | 30 |
| 6 | 60 | 40 |
| 5 | 50 | 50 |
| 4 | 40 | 60 |
| 3 | 30 | 70 |
| 2.5 | 25 | 75 |
| 2 | 20 | 80 |
| 1.5 | 15 | 85 |

TABLE 1-continued

| Water repellency test liquid (% by volume) | | |
|---|---|---|
| Point | Isopropyl alcohol | Water |
| 1 | 10 | 90 |
| 0.5 | 5 | 95 |
| 0.2 | 2 | 98 |
| 0 | 0 | 100 |
| Fail | Inferior to isopropyl alcohol 0/water 100 | |

Oil Repellency Test

A carpet treated with a water- and oil-repellent agent is stored in a thermo-hygrostat having a temperature of 21° C. and a humidity of 65% for at least 4 hours. A test liquid (shown in Table 2) which has been also stored at 21° C. is used. The test is conducted in an air-conditioned room having a temperature of 21° C. and a humidity of 65%. Droplets of the test liquid in an amount of 50 μL (5 droplets) are softly dropped by a micropipette on the carpet. If 4 or 5 droplets remain on the carpet after standing for 30 seconds, the test liquid passes the test. The oil repellency is expressed by a point corresponding to a maximum content of isopropyl alcohol (% by volume) in the test liquid which passes the test. The oil repellency is evaluated as nine levels which are Fail, 0, 1, 2, 3, 4, 5, 6, 7 and 8 in order of a bad level to an excellent level.

TABLE 2

| Oil repellency test | | |
|---|---|---|
| Point | Test liquid | Surface tension (dyne/cm, 25° C.) |
| 8 | n-Heptane | 20.0 |
| 7 | n-Octane | 21.8 |
| 6 | n-Decane | 23.5 |
| 5 | n-Dodecane | 25.0 |
| 4 | n-Tetradecane | 26.7 |
| 3 | n-Hexadecane | 27.3 |
| 2 | Mixture liquid of n-Hexadecane 35/nujol 65 | 29.6 |
| 1 | Nujol | 31.2 |
| Fail | Inferior to 1 | — |

Soil Releasability (Stain Proof Property)

A carpet sample piece (size: 18.2 cm in a direction of tufting, and 8.9 cm in a direction perpendicular to a tufting direction) treated with a water- and oil-repellent agent and a blank carpet piece (size: 18.2 cm in direction of tufting, and 8.9 cm in a direction perpendicular to tufting direction) are kept to stand for 4 hours in an atmosphere of 21° C. and 65% RH. Before the soil releasability test, L*, a* and b* of the carpet pieces are measured at three spots. The carpet pieces are adhered with a double-sided tape to an internal surface of a pot of a ball mill. About 250 g of nylon balls (sphere diameter: 7 mm), to which dry soil (artificial soil having composition shown in Table 3, dried in a desiccator for at least 48 hours) is adhered (0.75 g of dry soil is adhered to 250 g of nylon balls), and 1 kg of iron balls (sphere diameter: 9 mm) are charged in the pot and then a lid is put on the pot. In the ball mill apparatus, a direction of rotation at 20 rpm is changed every 15 minutes, and the pot is rotated for total one hour. The lid of the pot is removed, the carpet samples are removed, and then the double-sided tapes are peeled off. Excess dry soil on the surface of carpet test piece is removed by a vacuum cleaner. The vacuum cleaner is applied in each direction (longitudinal and transverse directions) for back and forth twice. L*, a* and b* of each carpet piece without excess dry soil are measured at three spots by a color difference meter (CR-310 manufactured by MINOLTA Co., Ltd., having a circular detection part having a diameter of 50 mm).

A color difference (ΔE*ab) of the carpet surface is calculated according to the following equation from L*, a* and b* before soil releasability test and L*, a* and b* after soil releasability test. Since the measurement for each carpet sample is conducted at three spots, the calculation is conducted by using a value at the same spot.

$$\Delta E^*ab=[(\Delta L^*)^2+(\Delta a^*)^2+(\Delta b^*)^2]^{1/2}$$

ΔL*: difference of L* before and after soil releasability test

Δa*: difference of a* before and after soil releasability test

Δb*: difference of b* before and after soil releasability test

An average of ΔE*ab is determined for each carpet test sample, and this average is taken as ΔE, which is a result of soil releasability.

TABLE 3

| Components of artificial soil | Amount (wt %) |
|---|---|
| Peat moss | 38.4 |
| Cement | 18 |
| Kaolin | 18 |
| Silica | 18 |
| Carbon black | 1.15 |
| Ferric oxide (III) | 0.30 |
| Nujol | 6.25 |

Synthetic Example 1

Preparation of a Rf(OH)Maleate 65.0 g of maleic acid was added to 720 g (0.600 mol) of 3-perfluoroalkyl (a mixture wherein a molar ratio of Rf=$C_6F_{13}$, $C_8F_{17}$, $C_{10}F_{21}$, $C_{12}F_{25}$ and $C_{14}F_{29}$ is 2:50:30:15:3, an average molecular weight of 528)-1,2-epoxy propane and heated to 140° C. and dissolved. The reaction was conducted for 8 hours.

A gas chromatography analysis revealed that a convertion ratio of 3-perfluoroalkyl-1,2-epoxypropane was 100%. A mass spectrum revealed that a new peak in gas chromatography corresponds to bis-3-perfluoroalkyl-2-hydroxy-propyl maleate (R(OH)maleate) which is a product.

Preparative Example 1

785 g of Rf(OH)maleate obtained in Synthetic Example 1 was thoroughly dissolved in 196 g of methyl methacrylate, 185 g of ethyl methacrylate and 10.8 g of styrene, then 70.6 g of polyoxyethylene(20)alkyl ether (a nonioic emulsifier), 11.8 g of sodium a-olefin sulfonate (an anionic emulsifier) and 1,837 g of deionized water were added and the mixture was emulsified by a high-pressure homogenizer. The resultant emulsion was charged in a 2 L four-necked flask equipped with a reflux condenser, a nitrogen introducing tube, a thermometer and a stirrer and maintained at 60° C. for 1 hour under a nitrogen stream. Then, the polymerization was initiated by addition of 2.34 g of ammonium persulfate dissolved in 10 g of water, followed by stirring with heating at 60° C. for 3 hours to prepare an emulsion of a copolymer. The ratio of monomers in the resultant polymer was almost the same as the ratio of charged monomers.

Preparative Example 2

The types and amounts, shown in Table 4, of a fluorine-containing monomer, a fluorine-free monomer, a chain transfer agent, an emulsifier, an auxiliary solvent and water were mixed to prepare a mixture liquid. This mixture liquid was heated at 60° C., and then homogenized by a high-pressure homogenizer. The resultant emulsion was charged in a 1 L autoclave and the dissolved oxygen was eliminated by nitrogen replacement. Then, vinyl chloride was charged in the amount shown in Table 4, and an initiator was charged in the amount shown in Table 4. The copolymerization reaction was conducted under stirring at 60° C. for 8 hours to give a vinyl chloride-containing copolymer emulsion. The emulsion was diluted with water to give an emulsion having a solid content of 30% by weight.

Preparative Example 3

The types and amounts, shown in Table 4, of a fluorine-containing monomer, a fluorine-free monomer, a chain transfer agent, an emulsifier, an auxiliary solvent and water were mixed to prepare a mixture liquid. This mixture liquid was heated at 60° C., and then homogenized by a high-pressure homogenizer. The resultant emulsion was charged in a 1 L autoclave and the dissolved oxygen was eliminated by nitrogen replacement. Then, vinyl chloride was charged in the amount shown in Table 4, and an initiator was charged in the amount shown in Table 4. The copolymerization reaction was conducted under stirring at 60° C. for 8 hours to give a vinyl chloride-containing copolymer emulsion. The emulsion was diluted with water to give an emulsion having a solid content of 30% by weight.

Preparative Example 4

The types and amounts, shown in Table 4, of a fluorine-containing monomer, a fluorine-free monomer, a chain transfer agent, an emulsifier, an auxiliary solvent and water were mixed to prepare a mixture liquid. This mixture liquid was heated at 60° C., and then homogenized by a high-pressure homogenizer. The resultant emulsion was charged in a 1 L autoclave and the dissolved oxygen was eliminated by nitrogen replacement. Then, an initiator was charged in the amount shown in Table 4. The copolymerization reaction was conducted under stirring at 60° C. for 8 hours to give a fluorine-containing copolymer emulsion. The copolymer emulsion was diluted with water to give an emulsion having a solid content of 30% by weight.

Preparative Example 5

The fluorine-containing emulsion given in Preparative Example 3 and the fluorine-containing emulsion given in Preparative Example 4 were mixed in a solid ratio of 8:2 to give a fluorine-containing polymer emulsion.

Preparative Example 6

The types and amounts, shown in Table 4, of a fluorine-containing monomer, a fluorine-free monomer, a chain transfer agent, an emulsifier, an auxiliary solvent and water were mixed to prepare a mixture liquid. This mixture liquid was heated at 60° C., and then homogenized by a high-pressure homogenizer. The resultant emulsion was charged in a 1 L autoclave and the dissolved oxygen was eliminated by nitrogen replacement. Then, vinyl chloride was charged in the amount shown in Table 4, and an initiator was charged in the amount shown in Table 4. The copolymerization reaction was conducted under stirring at 60° C. for 8 hours to give a vinyl chloride-containing copolymer emulsion. The copolymer emulsion was diluted with water to give an emulsion having a solid content of 20% by weight.

Preparative Example 7

The types and amounts, shown in Table 4, of a fluorine-containing monomer, a fluorine-free monomer, a chain transfer agent, an emulsifier, an auxiliary solvent and water were mixed to prepare a mixture liquid. This mixture liquid was heated at 60° C., and then homogenized by a high-pressure homogenizer. The resultant emulsion was charged in a 1 L autoclave and the dissolved oxygen was eliminated by nitrogen replacement. Then, vinyl chloride was charged in the amount shown in Table 4, and an initiator was charged in the amount shown in Table 4. The copolymerization reaction was conducted under stirring at 60° C. for 8 hours to give a vinyl chloride-containing copolymer emulsion. The copolymer emulsion was diluted with water to give an emulsion having a solid content of 30% by weight.

WPU (wet pick up) amount of 400%. Then, a normal-pressure steamer treatment (temperature: 100° C. to 107° C.) was conducted for 90 seconds under the state that a pile surface was upside. The carpet was lightly rinsed with 2 L of water and then centrifugal dehydration was conducted to give a WPU amount of 25%. Finally, the carpet was thermally cured at 110° C. for 10 minutes.

The measurement of fluorine adhesion rate, the water repellency test and the oil repellency test were conducted. The results are shown in Table 5.

Example 1

Water was added to 1 g of the emulsion prepared in Preparative Example 1 and 30 g of 10% aqueous magnesium sulfate solution to dilute the emulsion to the total amount of 1,000 g. A 10% aqueous sulfamic acid solution was added to the emulsion so that pH of the emulsion was 1.5, to give a treatment liquid. In the same manner as in Comparative Example 1, the water and oil repellent agent was adhered to the carpet.

TABLE 4

| | Type and amount charged | | | | | | |
|---|---|---|---|---|---|---|---|
| | Abbreviation | Name | Pre. Ex. 2 | Pre. Ex. 3 | Pre. Ex. 4 | Pre. Ex. 6 | Pre. Ex. 7 |
| Fluorine-containing monomer | SFA | $CH_2{=}CHCOOCH_2CH_2(CF_2CF_2)_nCF_2CF_3$(mixture wherein n is 3, 4, 5 in a weight ratio of 5:3:1) purity 85% | 82.23 | 92.61 | 73.79 | 97.22 | 82.23 |
| Fluorine-free monomer | STA | Stearyl acrylate | 2.21 | 5.19 | 15.68 | | 2.21 |
| | VCl | Vinyl chloride | 20.77 | 12.78 | | 13.76 | 20.77 |
| | 2EHA | 2-Ethyl hexyl acrylate | 4.39 | | | | 4.39 |
| | 2EHMA | 2-Ethyl ethyl hexyl methacrylate | | | 15.68 | | |
| | DAAM | Diacetone acrylamide | 2.08 | | | | 2.08 |
| | BLEMMER G | Glycidyl methacrylate | | | 2.14 | | |
| | N-MAM | N-Methylol acrylamide | | 2.12 | 2.50 | 2.72 | |
| | TOPOLENE M | 3-Chloro-2-hydroxypropane | 0.49 | 0.52 | 1.08 | | 0.49 |
| Chain transfer agent | LSH | n-Lauryl mercaptan | 0.16 | 0.66 | 0.20 | 0.88 | 0.16 |
| Nonionic emulsifier | PP-40R | Sorbitan monopalmitate | | 1.67 | | | |
| | HS-208 | Polyoxyethylene(8)octylphenylether | | 3.66 | | | |
| | HS-220 | Polyoxyethylene(20)octylphenylether | | | 1.41 | 6.18 | |
| | PBC44 | Polyoxyethylene(20)polyoxypropylene(8)cetylether | | 4.95 | | | |
| | LP-20R | Sorbitan monolaulate | | | 1.78 | | |
| | EMULGEN 985 | Polyoxyethylene(85)nonylphenylether | | 1.67 | | | |
| | BL-21 | Polyoxyethylene(21)laurylether | 5.41 | | | | 5.41 |
| Cationic emulsifier | 2ABT | Dihardened tallow fatty acid alkyl dimethyl ammonium chloride | 1.58 | 1.74 | | 2.72 | 1.58 |
| | ETHOQUAD C12 | Cocobis(2-hydroxyethyl)methyl ammonium chloride | 1.78 | | | | 4.70 |
| Anionic emulsifier | HITENOL N-17 | Polyoxyethylene(22)alkylphenylether sulfate ammonium salt | | | 4.27 | | |
| Initiator | APS | Ammonium persulfate | | | 0.56 | 0.76 | 0.76 |
| | V-50 | 2,2'-Azobis(2-amidinopropane) dihydrochloride | 0.76 | 0.76 | | | |
| Auxiliary solvent | DPM | Dipropyleneglycol monomethyl ether | | 30.00 | 30.00 | 30.00 | |
| | TPG | Tripropylene glycol | 30.00 | | | | 30.00 |
| Water | | Ion-exchanged water | 180.04 | 188.47 | 178.25 | 178.06 | 185.97 |

Comparative Example 1

Water was added to 1 g of the emulsion prepared in Preparative Example 1 to dilute the emulsion to the total amount of 1,000 g. A 10% aqueous sulfamic acid solution was added to the emulsion so that pH of the emulsion was 1.5, to give a treatment liquid.

A carpet (20 cm×20 cm, polyester, cut pile) was immersed in this treatment liquid for 30 seconds and squeezed to have a The measurement of fluorine adhesion rate, the water repellency test and the oil repellency test were conducted. The results are shown in Table 5.

Comparative Example 2

Water was added to 1 g of the emulsion prepared in Preparative Example 1 to dilute the emulsion to the total amount of 1,000 g. A 10% aqueous sulfamic acid solution was added to the emulsion so that pH of the emulsion was 2.0, to give a treatment liquid. In the same manner as in Comparative Example 1, the water and oil repellent agent was adhered to the carpet.

The measurement of fluorine adhesion rate, the water repellency test and the oil repellency test were conducted. The results are shown in Table 5.

Example 2

Water was added to 1 g of the emulsion prepared in Preparative Example 1 and 30 g of 10% aqueous magnesium sulfate solution to dilute the emulsion to the total amount of 1,000 g. A 10% aqueous sulfamic acid solution was added to the emulsion so that pH of the emulsion was 2.0, to give a treatment liquid. In the same manner as in Comparative Example 1, the water and oil repellent agent was adhered to the carpet.

The measurement of fluorine adhesion rate, the water repellency test and the oil repellency test were conducted. The results are shown in Table 5.

Comparative Example 3

Water was added to 1 g of the emulsion prepared in Preparative Example 1 to dilute the emulsion to the total amount of 1,000 g. A 10% aqueous sulfamic acid solution was added to the emulsion so that pH of the emulsion was 1.5, to give a treatment liquid. In the same manner as in Comparative Example 1, the water and oil repellent agent was adhered to the carpet.

The measurement of fluorine adhesion rate, the water repellency test and the oil repellency test were conducted. The results are shown in Table 5.

Example 3

Water was added to 1 g of the emulsion prepared in Preparative Example 2 and 30 g of 10% aqueous magnesium sulfate solution to dilute the emulsion to the total amount of 1,000 g. A 10% aqueous sulfamic acid solution was added to the emulsion so that pH of the emulsion was 1.5, to give a treatment liquid. In the same manner as in Comparative Example 1, the water and oil repellent agent was adhered to the carpet.

The measurement of fluorine adhesion rate, the water repellency test and the oil repellency test were conducted. The results are shown in Table 5.

TABLE 5

| | $MgSO_4$ [g/L] | Exhaustability (Fluorine adhesion rate) (%) | Water repellency | Oil repellency |
|---|---|---|---|---|
| Com. Ex. 1 | 0 | 29.7 | Fail | Fail |
| Ex. 1 | 3 | 83.7 | 0.2 | Fail |
| Com. Ex. 2 | 0 | 20.9 | Fail | Fail |
| Ex. 2 | 3 | 53.9 | 0.2 | Fail |
| Com. Ex. 3 | 0 | 45.9 | 4 | 4 |
| Ex. 3 | 3 | 79.6 | 8 | 6 |

Comparative Example 4

Water was added to 1 g of the emulsion prepared in Preparative Example 5 to dilute the emulsion to the total amount of 1,000 g. A 10% aqueous sulfamic acid solution was added to the emulsion so that pH of the emulsion was 1.5, to give a treatment liquid.

A carpet (20 cm×20 cm, nylon-66, cut pile, density: 36 oz/yd$^2$) was immersed in this treatment liquid for 30 seconds and squeezed to have a WPU (wet pick up) amount of 300%. Then, a normal-pressure steamer treatment (temperature: 100° C. to 107° C.) was conducted for 90 seconds under the state that a pile surface was upside. The carpet was lightly rinsed with 2 L of water and then centrifugal dehydration was conducted to give a WPU amount of 25%. Finally, the carpet was thermally cured at 110° C. for 10 minutes.

The measurement of fluorine adhesion rate, the water repellency test, the oil repellency test and the soil releasability test were conducted. The results are shown in Table 6.

Example 4

Water was added to 1 g of the emulsion prepared in Preparative Example 5 and 30 g of 10% aqueous magnesium sulfate solution to dilute the emulsion to the total amount of 1,000 g. A 10% aqueous sulfamic acid solution was added to the emulsion so that pH of the emulsion was 1.5, to give a treatment liquid. In the same manner as in Comparative Example 4, the water and oil repellent agent was adhered to the carpet.

The measurement of fluorine adhesion rate, the water repellency test, the oil repellency test and the soil releasability test were conducted. The results are shown in Table 6.

Comparative Example 5

Water was added to 1 g of the emulsion prepared in Preparative Example 5 to dilute the emulsion to the total amount of 1,000 g. A 10% aqueous sulfamic acid solution was added to the emulsion so that pH of the emulsion was 2.0, to give a treatment liquid. In the same manner as in Comparative Example 4, the water and oil repellent agent was adhered to the carpet.

The measurement of fluorine adhesion rate, the water repellency test, the oil repellency test and the soil releasability test were conducted. The results are shown in Table 6.

Example 5

Water was added to 1 g of the emulsion prepared in Preparative Example 5 and 30 g of 10% aqueous magnesium sulfate solution to dilute the emulsion to the total amount of 1,000 g. A 10% aqueous sulfamic acid solution was added to the emulsion so that pH of the emulsion was 2.0, to give a treatment liquid. In the same manner as in Comparative Example 4, the water and oil repellent agent was adhered to the carpet.

The measurement of fluorine adhesion rate, the water repellency test, the oil repellency test and the soil releasability test were conducted. The results are shown in Table 6.

TABLE 6

| | $MgSO_4$ [g/L] | Exhaust-ability (Fluorine adhesion rate) (%) | Water repellency | Water repellency | Soil releasability |
|---|---|---|---|---|---|
| Com. Ex. 4 | 0 | 44 | 3 | Fail | 3.63 |
| Ex. 4 | 3 | 71 | 3 | 1 | 3.3 |
| Com. Ex. 5 | 0 | 31 | 2 | Fail | 3.97 |
| Ex. 5 | 3 | 61 | 3 | Fail | 3.38 |

Comparative Example 6

Water was added to 1 g of the emulsion prepared in Preparative Example 6 to dilute the emulsion to the total amount of 1,000 g. A 10% aqueous sulfamic acid solution was added to the emulsion so that pH of the emulsion was 1.5, to give a treatment liquid.

A carpet (20 cm×20 cm, polyester, cut pile) was immersed in this treatment liquid for 30 seconds and squeezed to have a WPU (wet pick up) amount of 400%. Then, a normal-pressure steamer treatment (temperature: 100° C. to 107° C.) was conducted for 90 seconds under the state that a pile surface was upside. The carpet was lightly rinsed with 2 L of water and then centrifugal dehydration was conducted to give a WPU amount of 25%. Finally, the carpet was thermally cured at 110° C. for 10 minutes.

The measurement of fluorine adhesion rate, the water repellency test and the oil repellency test were conducted. The results are shown in Table 7.

Example 6

Each of 0.5 g, 1.0 g, 1.5 g and 2.0 g of ETHOQUAD C-12 was added to and mixed with the emulsion prepared in Preparative Example 6 to give a liquid having the total amount of 100 g. The resultant liquid had an ETHOQUAD content of 0.5%, 1.0%, 1.5% or 2.0%. Water was added to 1 g of the resultant liquid to dilute the resultant liquid to have the total amount of 1,000 g. A 10% aqueous sulfamic acid solution was added to the emulsion so that pH of the emulsion was 1.5, to give a treatment liquid. In the same manner as in Comparative Example 6, the water and oil repellent agent was adhered to the carpet.

The measurement of fluorine adhesion rate, the water repellency test and the oil repellency test were conducted. The results are shown in Table 7.

Example 7

1.5 g of CATION AB was added to 1 g of the emulsion prepared in Preparative Example 6 and diluted with water to give the total amount of 100 g. The concentration of CATION AB in the resultant liquid was 1.5%. Water was added to 1 g of the resultant liquid to give the total amount of 1,000 g. A 10% aqueous sulfamic acid solution was added to the diluted liquid so that pH of the emulsion was 1.5, to give a treatment liquid. In the same manner as in Comparative Example 6, the water and oil repellent agent was adhered to the carpet.

The measurement of fluorine adhesion rate, the water repellency test and the oil repellency test were conducted. The results are shown in Table 7.

Example 8

1.5 g of CATION 2ABT was added to 1 g of the emulsion prepared in Preparative Example 6 to give the total amount of 100 g. The concentration of CATION 2ABT in the resultant liquid was 1.5%. Water was added to 1 g of the resultant liquid to give the total amount of 1,000 g. A 10% aqueous sulfamic acid solution was added to the diluted liquid so that pH of the emulsion was 1.5, to give a treatment liquid. In the same manner as in Comparative Example 6, the water and oil repellent agent was adhered to the carpet.

The measurement of fluorine adhesion rate, the water repellency test and the oil repellency test were conducted. The results are shown in Table 7.

TABLE 7

| | Emulsifier | Addition amount (%) | Exhaustability (Fluorine adhesion rate) (%) | Water repellency | Oil repellency |
|---|---|---|---|---|---|
| Com. Ex. 6 | None | 0 | 38.7 | 2.5 | 1 |
| Ex. 6 | C-12 | 0.5 | 46.4 | 3 | 2 |
| | | 1.0 | 70.0 | 4 | 4 |
| | | 1.5 | 70.8 | 6 | 5 |
| | | 2.0 | 67.2 | 6 | 5 |
| Ex. 7 | AB | 1.5 | 58.8 | 4 | 4 |
| Ex. 8 | 2ABT | 1.5 | 62.9 | 4 | 3 |

Example 9

Water was added to 1 g of the emulsion prepared in Preparative Example 7 to dilute the emulsion to the total amount of 1,000 g. A 10% aqueous sulfamic acid solution was added to the emulsion so that pH of the emulsion was 1.5, to give a treatment liquid. In the same manner as in Comparative Example 1, the water and oil repellent agent was adhered to the carpet.

The measurement of fluorine adhesion rate, the water repellency test and the oil repellency test were conducted. The results are shown in Table 8.

TABLE 8

| | Exhaustability (Fluorine adhesion rate) (%) | Water repellency | Oil repellency |
|---|---|---|---|
| Com. Ex. 3 | 45.9 | 4 | 4 |
| Ex. 9 | 69.0 | 6 | 5 |

EFFECTS OF THE INVENTION

The present invention has the advantageous effects that the excellent water repellency and oil repellency are imparted to a textile.

What is claimed is:

1. A method of preparing a treated textile, comprising steps of:

(1) preparing a treatment liquid comprising a water- and oil-repellent agent, (2) adjusting pH of the treatment liquid to at most 7, (3) applying the treatment liquid to a textile wherein said textile is a propylene fiber, (4) treating the textile with steam, and (5) washing the textile with water and dehydrating the textile, wherein the water- and oil-repellent agent comprises a fluorine-containing polymer having a weight average molecular weight of 2,000 to 1,000,000 and a fluorine-containing low molecular weight compound, the treatment liquid contains both a cationic emulsifier and a salt, and the treatment liquid does not contain a stain blocking agent, and wherein the fluorine-containing polymer comprises:

(I) repeat unit derived from a fluoroalkyl group-containing monomer selected from the group consisting of a fluoroalkyl group-containing (meth)acrylate, a fluoroalkyl group-containing maleate or fumarate, and a fluoroalkyl group-containing urethane, and (II) repeat unit derived from a fluorine-free monomer selected from the group consisting of vinyl halide and vinylidene halide, and the fluorine-containing low molecular weight compound has a molecular weight of less than 2,000, and wherein the salt is selected from the group consisting of a metal salt of an organic acid and an inorganic acid.

2. The method according to claim 1, wherein said preparing step comprises emulsifying the water- and oil-repellent agent with the cationic emulsifier.

3. The method according to claim 1, wherein, said preparing step comprises first preparing said water- and oil-repellent agent, and then adding the cationic emulsifier and the salt to the water- and oil-repellent agent to obtain said treatment liquid.

4. The method according to claim 1, wherein the cationic emulsifier is a quatenary ammonium salt.

5. The method according to claim 1, wherein the cationic emulsifier is selected from the group consisting of an alkyltrimethyl ammonium salt, a dialkyldimethyl ammonium salt and a dipolyoxyethylenealkylmethyl ammonium salt.

6. The method according to claim 1, wherein the organic acid is selected from the group consisting of a carboxylic acid, a sulfonic acid and a sulfate monoester.

7. The method according to claim 1, wherein a metal in the metal salt of organic acid is a mono- to tetra-valent metal.

8. The method according to claim 1, wherein the inorganic acid is selected from the group consisting of hydrochloric acid, sulfuric acid, sulfurous acid, nitric acid, phosphorous acid and phosphoric acid.

9. The method according to claim 1, wherein a metal in the metal salt of inorganic acid is a mono- to tetra-valent metal.

10. The method according to claim 1, wherein the metal salt of inorganic acid is selected from the group consisting of magnesium sulfate, aluminum sulfate, sodium sulfate, aluminum chloride, barium chloride, calcium chloride, magnesium chloride and sodium chloride.

11. The method according to claim 1, wherein the fluorine-containing polymer further comprises:

(III) a repeat unit derived from a crosslinkable monomer.

12. The method according to claim 1, wherein pH of the treatment liquid is adjusted to at most 4 in the step (2).

13. The method according to claim 1, wherein the salt is present in an amount from 0.1 to 0.5 parts by weight, based on 1 part by weight of the fluorine-containing compound.

14. The method according to claim 1, wherein the salt is present in an amount from 50 to 500 parts by weight, based on 1 part by weight of the fluorine-containing compound.

15. The method according to claim 1, wherein the salt is present in an amount from 200 to 500 parts by weight, based on 1 part by weight of the fluorine-containing compound.

* * * * *